US008549756B2

(12) United States Patent
Heckman et al.

(10) Patent No.: US 8,549,756 B2
(45) **Date of Patent: *Oct. 8, 2013**

(54) HAIR CLIPPER WITH A VIBRATOR MOTOR

(75) Inventors: Greg A. Heckman, Dixon, IL (US); Robert N. Buck, Rock Falls, IL (US); Scott A. Melton, Erie, IL (US); Matthew J. Bowers, Dixon, IL (US); Edward D. Brill, Sterling, IL (US); Rick L Habben, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/593,109

(22) Filed: Aug. 23, 2012

(65) Prior Publication Data

US 2012/0311871 A1 Dec. 13, 2012

Related U.S. Application Data

(62) Division of application No. 12/852,862, filed on Aug. 9, 2010, now Pat. No. 8,276,279.

(51) Int. Cl.
*B26B 19/02* (2006.01)

(52) U.S. Cl.
USPC ..... 30/208; 30/209; 30/210

(58) Field of Classification Search
USPC ..... 310/29, 36–38, 46–48, 81; 30/43.91, 30/43.92, 208–210
See application file for complete search history.

(56) References Cited

U.S. PATENT DOCUMENTS

| | | | |
|---|---|---|---|
| 1,558,729 | A | 10/1925 | Wahl |
| 1,654,840 | A | 1/1928 | Shivers |
| 1,798,756 | A | 3/1931 | Redfield |

(Continued)

FOREIGN PATENT DOCUMENTS

| | | |
|---|---|---|
| DE | 102008003135 | 7/2009 |
| DE | 102008003136 | 7/2009 |

(Continued)

OTHER PUBLICATIONS

Partial EP Search Report issued in EP App. No. 11 17 6639, dated Nov. 16, 2011.

(Continued)

*Primary Examiner* — Jason Daniel Prone
(74) *Attorney, Agent, or Firm* — Greer, Burns & Crain, Ltd.

(57) ABSTRACT

A vibrator motor in a hair clipper has a stationary piece and a moving piece. The stationary piece has a primary leg and at least one secondary leg. The primary leg fits through an opening in a coil. A flange is then press fit onto the leg so that the coil is captured on the primary leg. The flange provides a magnetic pole face that is larger than the opening in the coil, which increases the efficiency of the motor. The flange is press fit in a single operation by pressing a primary prong into a primary socket, and pressing two secondary prongs into secondary sockets. The secondary prongs are guided inwardly as they enter the secondary sockets, which closes the primary socket around the primary prong. A drive arm is secured to an arm of the moving piece. The arm is angled in relation to the drive arm to put even pressure on the moving blade in the hair clipper.

4 Claims, 11 Drawing Sheets

(56) References Cited

U.S. PATENT DOCUMENTS

| | | | |
|---|---|---|---|
| 1,834,737 | A | 12/1931 | Redfield |
| 1,838,836 | A | 12/1931 | Jeffrey et al. |
| 1,891,486 | A | 12/1932 | Wahl |
| 2,240,890 | A | 5/1941 | Kavle |
| 2,283,551 | A | 5/1942 | Hanley |
| 2,521,653 | A | 9/1950 | Ruud |
| 2,565,697 | A | 8/1951 | Odstrcil |
| 2,595,718 | A | 5/1952 | Snavely |
| 2,699,509 | A | 1/1955 | Lee et al. |
| 2,747,113 | A | 5/1956 | Wahl |
| 2,759,114 | A | 8/1956 | Rolli et al. |
| 2,814,866 | A | 12/1957 | Bagno |
| 2,877,364 | A | 3/1959 | Wahl et al. |
| 2,967,253 | A | 1/1961 | Wahl |
| 2,986,662 | A | 5/1961 | Wahl |
| 3,010,036 | A | 11/1961 | Wahl |
| 3,026,430 | A | 3/1962 | Wahl |
| 3,114,851 | A | 12/1963 | Santi |
| 3,272,998 | A | 9/1966 | Spohr |
| 3,296,468 | A | 1/1967 | Townshend |
| 3,346,828 | A | 10/1967 | Buschman |
| 3,357,101 | A | 12/1967 | Davis |
| 3,443,137 | A | 5/1969 | McElroy |
| 3,493,793 | A | 2/1970 | Niemela |
| 3,570,122 | A | 3/1971 | Williams |
| 3,679,921 | A | 7/1972 | Jank |
| 3,735,297 | A | 5/1973 | Pfenning |
| 3,793,129 | A | 2/1974 | Doggart et al. |
| 3,840,760 | A | 10/1974 | Boer |
| 3,898,732 | A | 8/1975 | Krainer |
| 3,906,263 | A | 9/1975 | Chen et al. |
| 4,240,200 | A | 12/1980 | Bukoschek |
| 4,270,509 | A | 6/1981 | Tharman |
| 4,392,092 | A | 7/1983 | Gassner |
| 4,506,182 | A | 3/1985 | Rohdin |
| 4,897,916 | A | 2/1990 | Blackburn |
| 5,047,745 | A | 9/1991 | Marriott et al. |
| 2,348,556 | A | 5/1994 | Matthias |
| 5,671,526 | A | 9/1997 | Merlano |
| 5,780,951 | A | 7/1998 | Stephens |
| 5,787,587 | A | 8/1998 | Wahl et al. |
| 5,860,207 | A | 1/1999 | Knight et al. |
| 6,023,119 | A | 2/2000 | Asao |
| 6,060,978 | A | 5/2000 | Marquardt |
| 6,559,563 | B1 | 5/2003 | Shimizu et al. |
| 6,658,740 | B2 | 12/2003 | Habben |
| D497,452 | S | 10/2004 | Nielsen et al. |
| 6,800,983 | B1 | 10/2004 | Iijima et al. |
| 6,933,630 | B2 | 8/2005 | Kraus et al. |
| 7,239,053 | B2 | 7/2007 | Brill |
| 7,646,281 | B2 | 1/2010 | Diekmann et al. |
| 8,276,279 | B2 * | 10/2012 | Heckman et al. ..... 30/208 |
| 2002/0170180 | A1 | 11/2002 | Brill et al. |
| 2010/0300480 | A1 | 12/2010 | Pilcher et al. |
| 2010/0307009 | A1 | 12/2010 | Schwer et al. |

FOREIGN PATENT DOCUMENTS

| | | | |
|---|---|---|---|
| EP | 0 802 614 | A1 | 10/1997 |
| EP | 1240984 | | 9/2002 |
| EP | 2 194 632 | A1 | 6/2010 |
| GB | 885711 | | 12/1961 |
| JP | 10056767 | A | 2/1998 |
| JP | 2002292161 | A | 10/2002 |
| JP | 2012035084 | A | 2/2012 |
| WO | WO 00/27599 | | 5/2000 |

OTHER PUBLICATIONS

Extended European Search Report dated Mar. 16, 2012 (in English), issued in EP App. No. 11 17 6639.

Extended European Search Report dated Mar. 9, 2012 (in English), issued in EP App. No. 11 17 6639.

* cited by examiner

HAIR CLIPPER WITH A VIBRATOR MOTOR

This application is a divisional of application Ser. No. 12/852,862, filed Aug. 9, 2010, now U.S. Pat. No. 8,276,279 B2.

This invention relates to vibrator motors, and more particularly to vibrator motors for hair clippers, massagers, and the like which are more efficient than conventional vibrator motors.

BACKGROUND OF THE INVENTION

Vibrator motors have been used in electric hair clippers for many years. Vibrator motors seen in U.S. Pat. No. 5,787,587, incorporated by reference in its entirety, improved on that technology. However, even those motors left room for further improvement.

Accordingly, one object of this invention is to provide new and improved vibrator motors.

Another object is to provide new and improved vibrator motors for hair clippers, massagers and the like.

Yet another object is to provide new and improved vibrator motors which are more efficient than conventional vibrator motors.

SUMMARY OF THE INVENTION

In keeping with one aspect of an embodiment of the invention, a vibrator motor in a hair clipper has a stationary piece and a moving piece. The stationary piece has a primary leg and at least one secondary leg. A coil has an opening that allows the coil to fit over the primary leg. A flange is then press fit onto the leg so that the coil is captured on the primary leg. The flange provides a magnetic pole face that is larger than the opening in the coil, which increases the efficiency of the motor.

In another aspect, the flange is press fit in a single operation by pressing a primary prong into a primary socket, and pressing two secondary prongs into secondary sockets. The secondary prongs are guided inwardly as they enter the secondary sockets, which secures the primary socket around the primary prong.

In still another aspect, a drive arm is secured to an arm of the moving piece. The drive arm moves a reciprocating blade in the hair clipper. The arm of the moving piece is angled in relation to the reciprocating blade to put even pressure on the moving blade.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
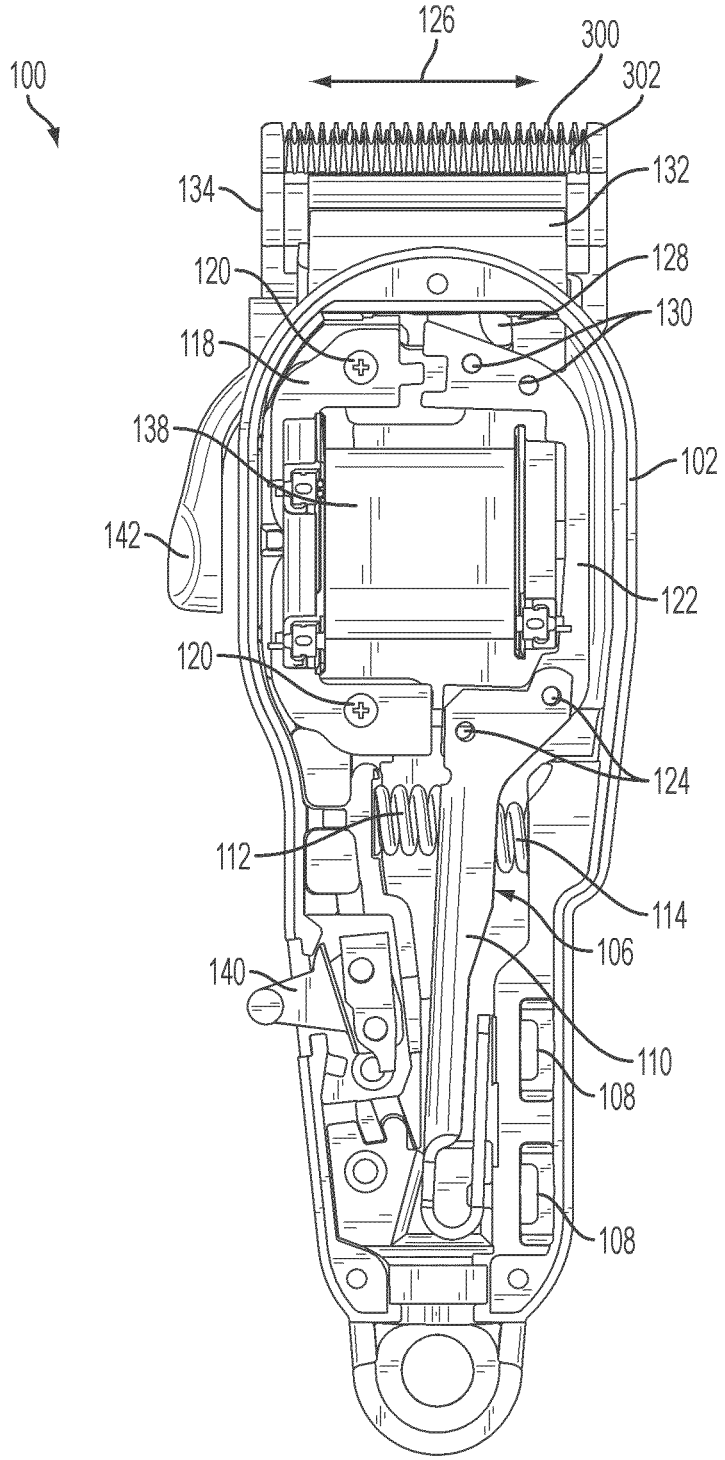
FIG. 1 is a front view of a hair clipper having one embodiment of a vibrator motor made in accordance with the present invention, shown with the cover removed.
Figure 2:
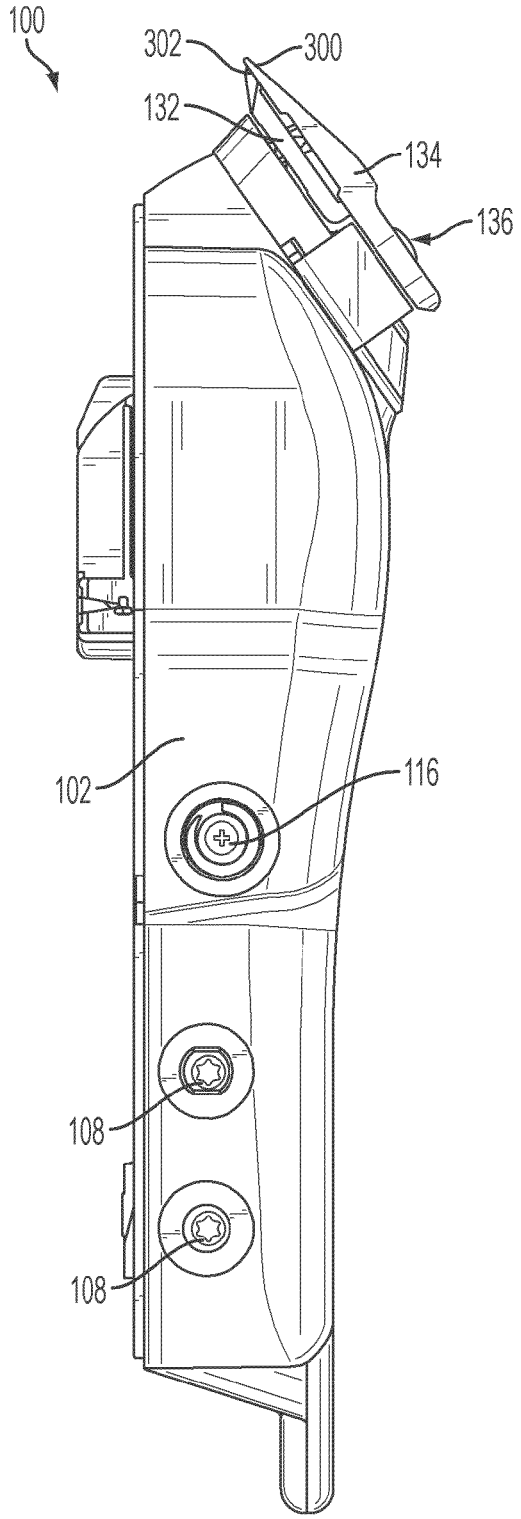
FIG. 2 is a side view of the hair clipper of FIG. 1.

As seen in FIGS. 1 and 2, a hair clipper 100 has a housing 102 and a cover (not shown). A mechanical spring system 106 is secured towards one end of the housing 102 by screws 108 (FIG. 2). The spring system 106 (FIG. 1) includes a spring arm 110, springs 112, 114, and an adjustment screw 116 (FIG. 2).

A stationary magnetically permeable piece such as a stack of stationary laminations 118 (FIG. 1) is secured to the housing 102 by screws 120. A moving magnetically permeable piece such as a stack of complementary moving laminations 122 is secured at one end to the spring arm 110 by rivets 124. In operation, the lamination stack 122 has a general direction of movement towards and away from the stationary laminations 118, as shown generally by the arrow 126.

Figure 3A:
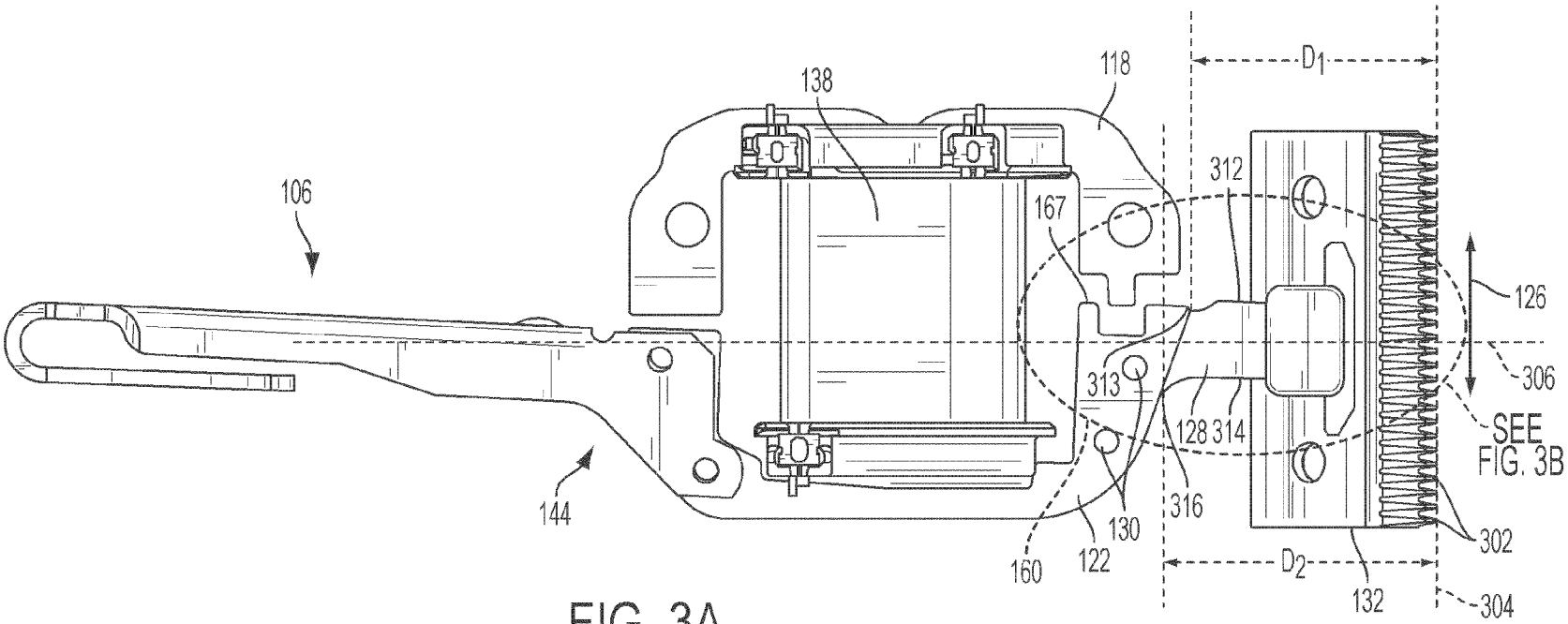
FIG. 3A is a front view of the vibrator motor used in the hair clipper of FIG. 1, shown with the reciprocating blade of the hair clipper.

As seen in FIG. 3A, a drive arm 128 is secured to the distal end of the moving laminations 122 by rivets 130. A reciprocating blade 132 is secured to the drive arm 128, and a stationary blade 134 is secured to the housing 102 by screws 136 (FIG. 2). The drive arm 128 is flexible, and puts spring pressure against the reciprocating blade 132.

A coil 138 is secured to the stationary laminations 118 (FIG. 1). The coil can be powered by line voltage through an on/off switch 140. A cutting adjustment device 142 can also be provided.

Referring again to FIG. 3A, a motor 144 in the hair clipper 100 includes the mechanical spring system 106 (partially shown in FIG. 3A), the stack of stationary laminations 118, the stack of complementary moving laminations 122, the drive arm 128 and the coil 138.

Figure 4:
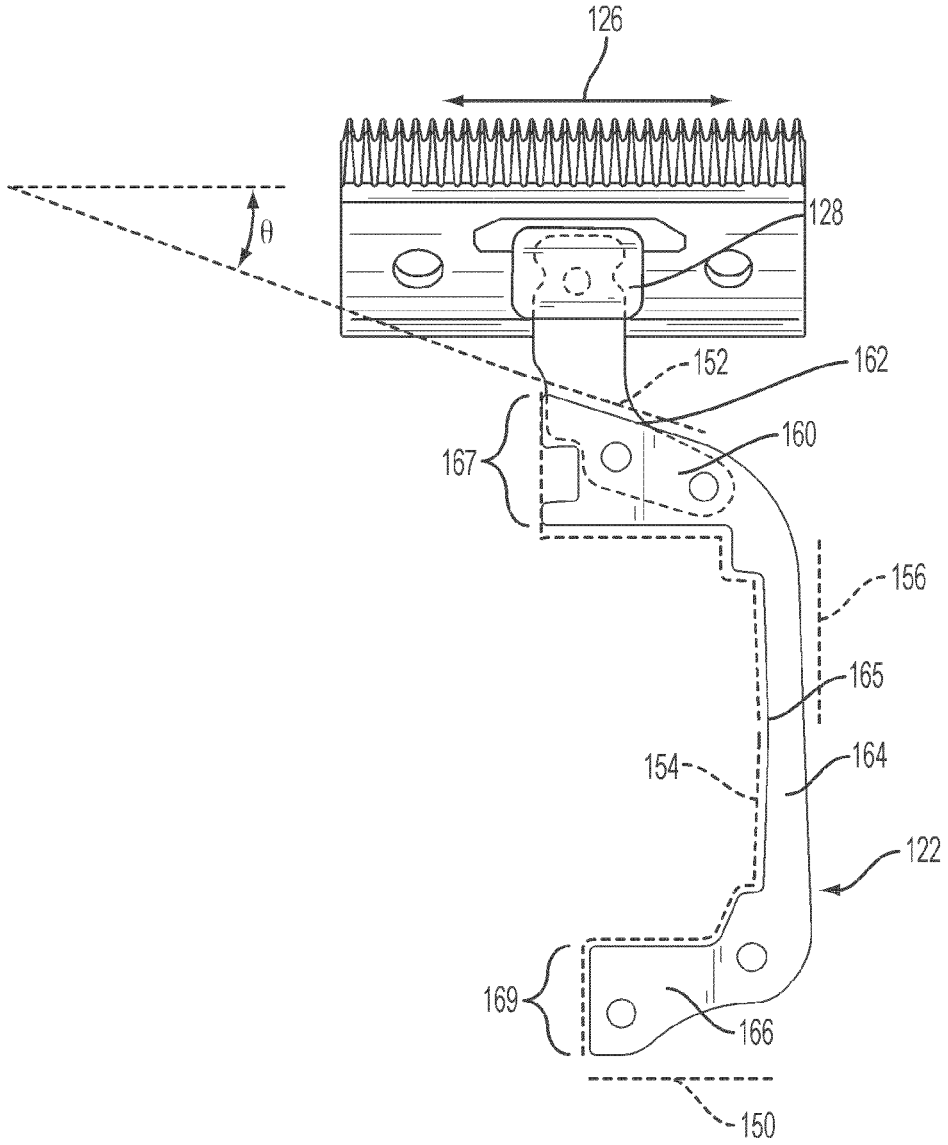
FIG. 4 is a front view of the moving laminations and drive arm of the vibrator motor of FIG. 3A, and the moving blade of the hair clipper of FIG. 1.

The moving laminations 122 (FIG. 4) have a proximate side 150 adjacent the spring system 106, and a distal side 152 opposite the proximate side 150. An inner side 154 is located adjacent the stationary laminations 118 (not shown in FIG. 4), and an outer side 156 is on the opposite side of the inner side 154.

The moving laminations 122 (FIG. 4) have a first arm 160 along the distal side 152. The arm 160 extends generally parallel to the direction of movement 126, although an outer edge 162 forms an acute angle θ with direction to the movement 126. The first arm 160 extends from a transverse back 164, which extends along the outer side 156 generally perpendicular to the arm 160.

A second arm 166 is provided along the proximate side 150. The arm 166 also extends generally parallel to the direction of movement 126, and extends from the transverse back 164.

The transverse back 164 has a primary moving pole face 165. The arm 160 has a first secondary moving pole face 167, and the arm 166 has a second secondary moving pole face 169.

Figure 7:
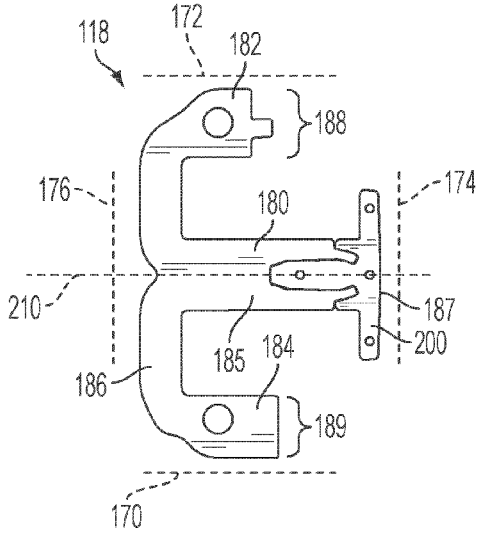
FIG. 7 is a front view of the assembled stationary laminations of the vibrator motor of FIG. 3A.

Referring to FIG. 7, the stationary laminations 118 have a near side 170 adjacent the spring system 106, a far side 172 opposite the near side 170, a close side 174 adjacent the moving laminations (not shown in FIG. 7), and a remote side 176 opposite the close side 174.

The stationary laminations 118 have a primary leg 180 between a first secondary leg 182 and the second secondary leg 184. The primary leg 180 extends from a transverse spine 186 that extends along the remote side 176. The first secondary leg 182 extends along the far side 172 from an end of the transverse spine 186. The first secondary leg 182 is generally parallel to the first arm 160 of the moving laminations. The second secondary leg 184 extends along the near side 170 generally parallel to the second arm 166 of the moving laminations. The second secondary leg 184 extends from the transverse spine 186.

The primary leg 180 has a primary pole face 187. The first secondary leg 182 has a first secondary pole face 188, and the second secondary leg 184 has a second secondary pole face 189.

Figure 5:
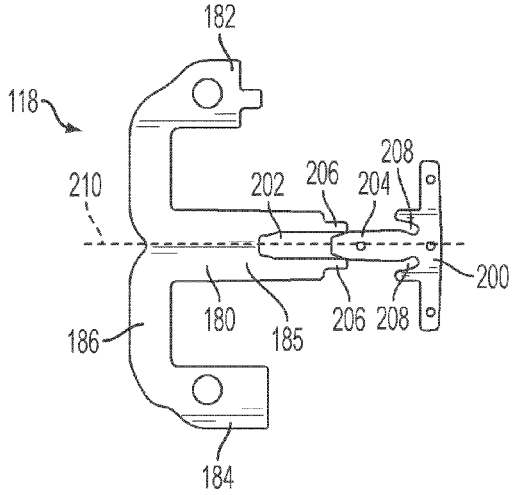
FIG. 5 is a view of the stationary laminations in the vibrator motor of FIG. 3A, before assembly.
Figure 6:
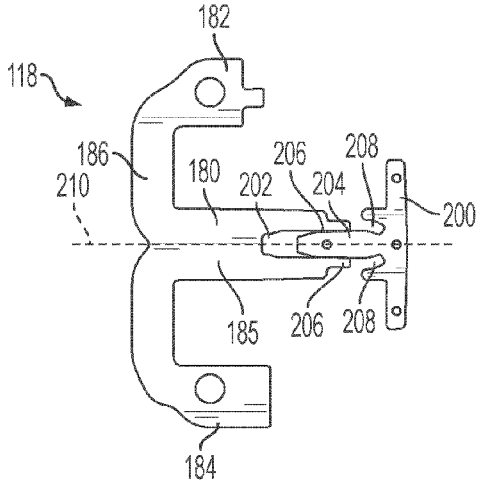
FIG. 6 is a view of the stationary laminations in the vibrator motor of FIG. 3A, during assembly.

Referring now to FIGS. 5, 6 and 7, the stationary laminations include a flange 200. The flange 200 is secured to a mid-section 185 of the primary leg 180 by a press fit between a primary socket 202 in the mid-section 185 and a primary prong 204 in the flange 200. The mid-section 185 and flange 200 are further secured by press fits between two secondary prongs 206 in the mid-section 185 and two secondary sockets 208 in the flange 200. The secondary sockets 208 guide the secondary prongs 206 inwardly towards a center line 210, as seen in FIG. 7.

Figure 8:
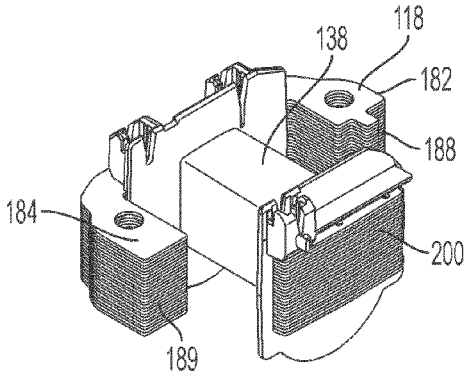
FIG. 8 is a perspective view of the stationary laminations and coil core in the vibrator motor of FIG. 3A.
Figure 9:
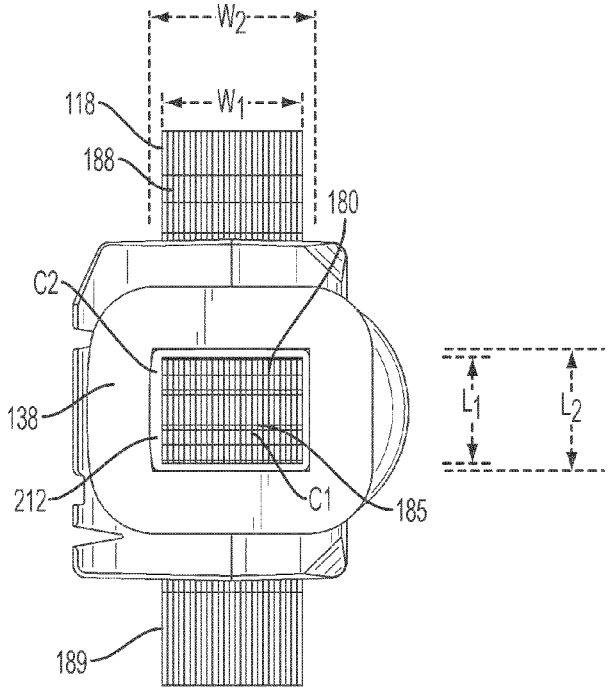
FIG. 9 is a side view of the stationary laminations and coil in the vibrator motor of FIG. 3A, shown without the flange.

The coil 138 is placed over the mid-section 185 of the primary leg 180 before the flange 200 is secured to the leg 180, as seen in FIG. 9. The primary prong 204 is then pressed into the primary socket 202, as shown in FIGS. 5 and 6. The laminations bend slightly as the flange 200 is pressed inwardly and do not recover in a spring-like manner. However, the secondary prongs 206 pull the mid-section 185 tightly around the primary prong 204 because the secondary sockets 208 are angled inwardly towards the center line 210. When the flange 200 is installed, the coil 138 is held in place, as seen in FIG. 8. In FIG. 8, the wire has been removed from the coil for clarity. The plastic bobbin or coil core is shown.

FIG. 9 shows the coil 138 on the mid-section 185 of the primary leg 180 without the flange 200. The mid-section 185 has a width W1, a length L1 and a cross-sectional area C1. The coil 138 has a plastic coil core (FIG. 8) with an opening 212, having a width W2, length L2 and cross-sectional area C2 sufficiently larger than W1, L1 and C1 to allow the coil to easily slip over the leg 180.

Figure 10:
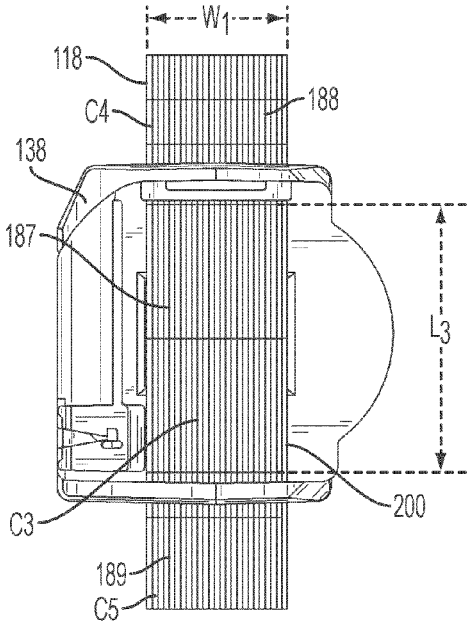
FIG. 10 is a side view of the stationary laminations and coil in the vibrator motor of FIG. 3A, shown with the flange secured.

FIG. 10 shows the coil 138 on the primary leg 180 after the flange 200 has been installed. The pole face 187 of the flange 200 has the width W1, a length L3 and a cross-sectional area C3. The length L3 is greater than the length L2, so C3 is greater than C2, and the flange 200 secures the coil on the leg 180.

The pole face 188 has a cross-sectional area of C4 as viewed in FIG. 9, and the pole face 189 has a cross-sectional area of C5. The cross-sectional area C3 of one embodiment is about 130% of the sum of the cross-sectional areas C4 and C5. However, it is believed that C3 should at least be equal to the sum of C4 and C5.

Figure 11A:
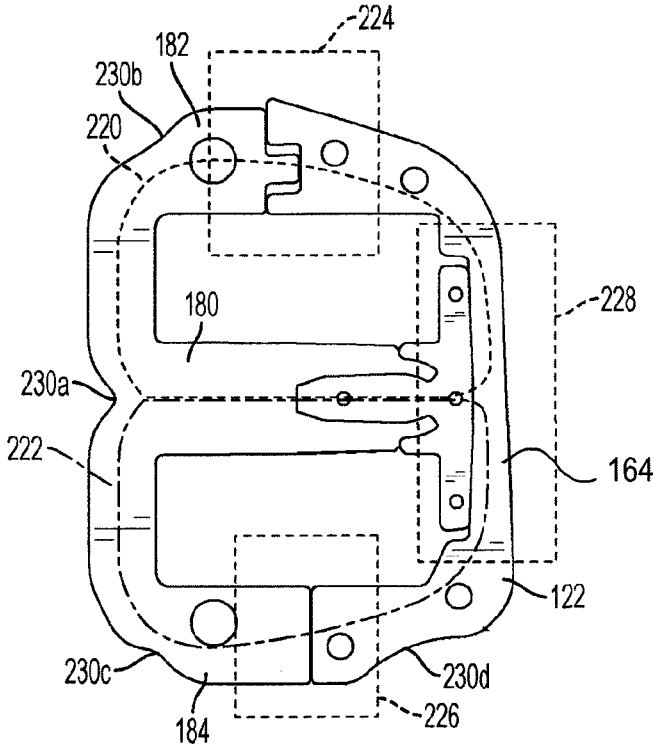
FIG. 11A is a diagram of the magnetic paths and flux zones in the vibrator motor of FIG. 3A, showing the laminations in the closed position.
Figure 11B:
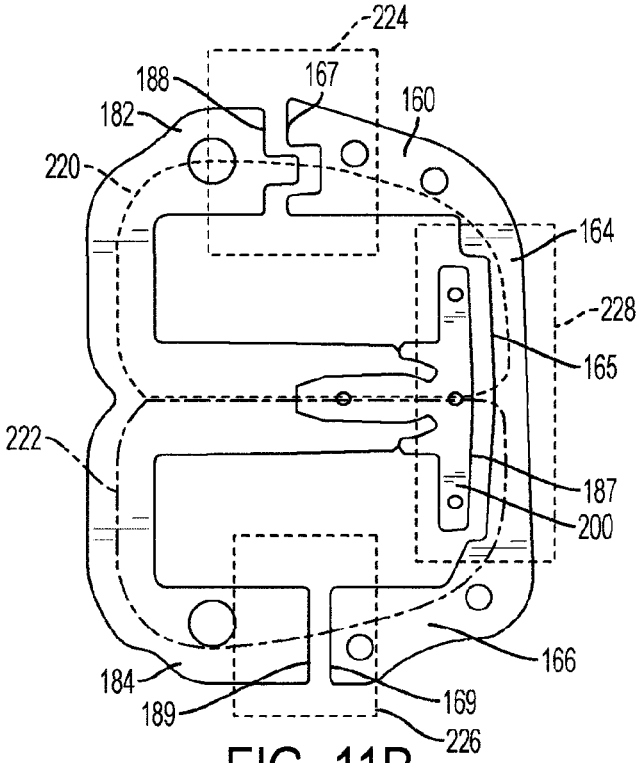
FIG. 11B is a diagram of the magnetic paths and flux zones in the vibrator motor of FIG. 3A, showing the laminations in the open position.

The legs of the stationary laminations and the arms of the moving laminations form two paths 220, 222 for the flow of magnetic flux, as seen in FIGS. 11A and 11B. FIG. 11A shows the laminations closed without touching, and FIG. 11B shows the laminations open. Air gaps between the open faces of respective arms and legs induce movement of the moving laminations when a changing electrical field is applied to the coil.

Each of the air gaps forms a magnetic flux zone between the complementary open faces of the legs and arms. Referring again to FIG. 11B, a first flux zone 224 is formed between the pole face 188 of the first secondary leg 182 and the pole face 167 of the first arm 160. A second magnetic flux zone 226 is formed between the pole face 189 of the leg 184 and the pole face 169 of the arm 166. A third magnetic flux zone 228 is formed between the pole face 187 of the flange 200 and the primary pole face 165 of the transverse back 164. Notches 230*a*, 230*b* and 230*c* (FIG. 11A) can be located in areas of low flux, if desired, to save material costs without adversely affecting performance. These notches are located in the stationary laminations. Notch 230*a* is adjacent the primary leg 180, the notch 230*b* is adjacent the first secondary leg 182, and the notch 230*c* is adjacent the second secondary leg 184. A notch 230*d* is provided on the moving laminations 122.

Figure 12A:
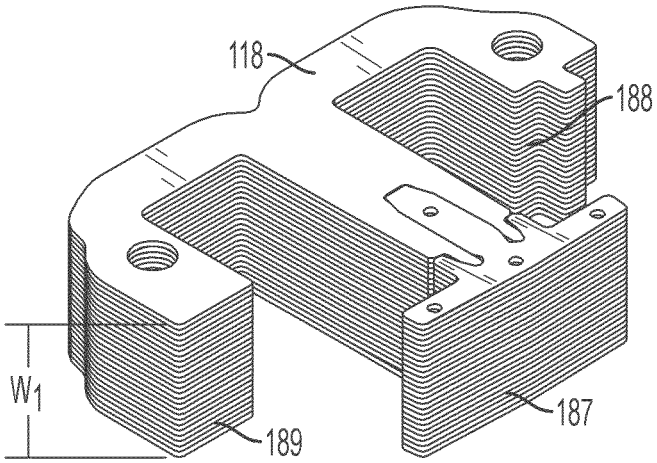
FIG. 12A is perspective view of the stationary laminations in the vibrator motor of FIG. 3A.
Figure 12B:
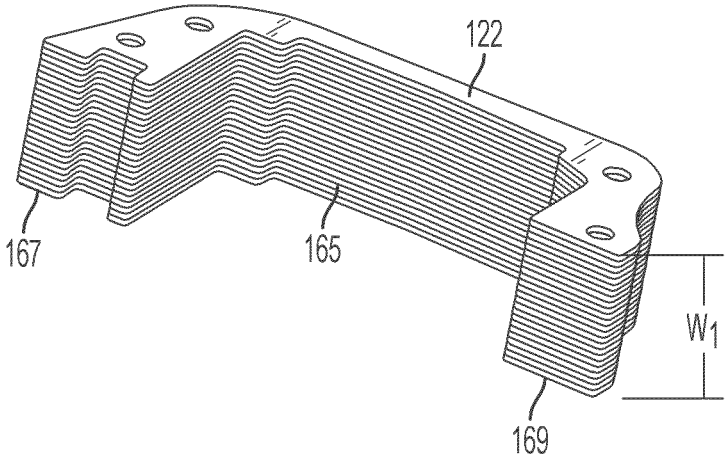
FIG. 12B is a perspective view of the moving laminations in the vibrator motor of FIG. 3A.
Figure 13A:
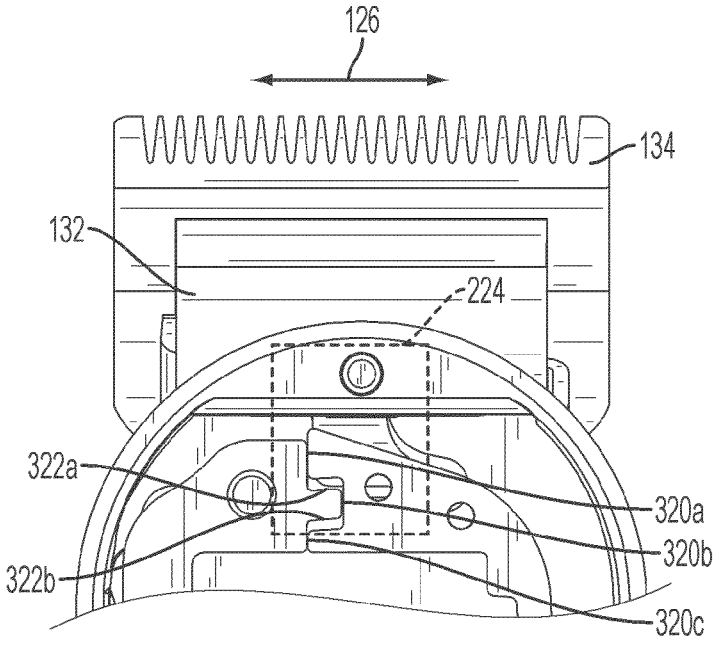
FIG. 13A is a cut-a-way view of the hair clipper of FIG. 1, showing the moving laminations in a closed position, centered with respect to the stationary laminations.
Figure 13B:
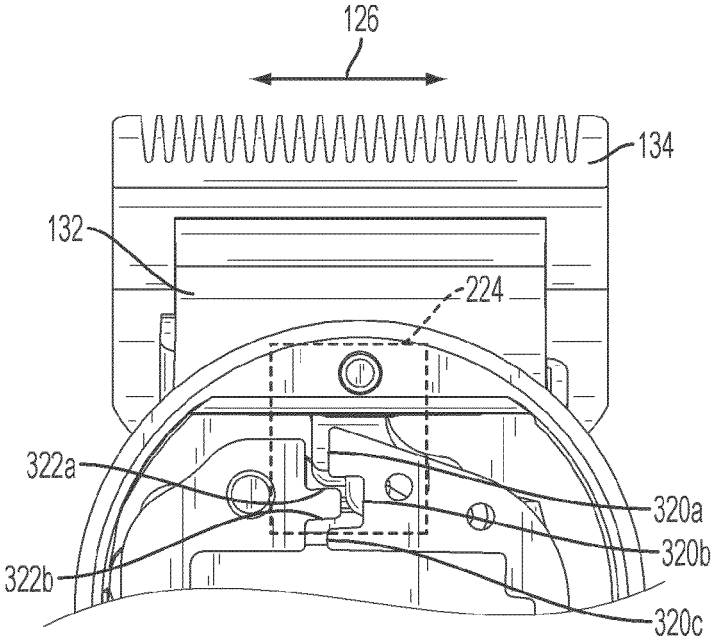
FIG. 13B is a cut-a-way view of the hair clipper of FIG. 1, showing the moving laminations in an open position, centered with respect to the stationary laminations.
Figure 13C:
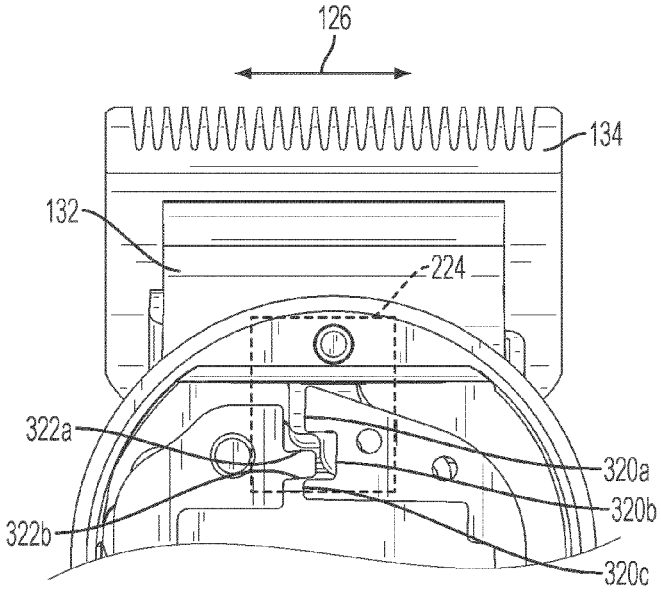
FIG. 13C is a cut-a-way view of the hair clipper of FIG. 1, showing the moving laminations in an open position, with the moving laminations skewed upwardly.
Figure 13D:
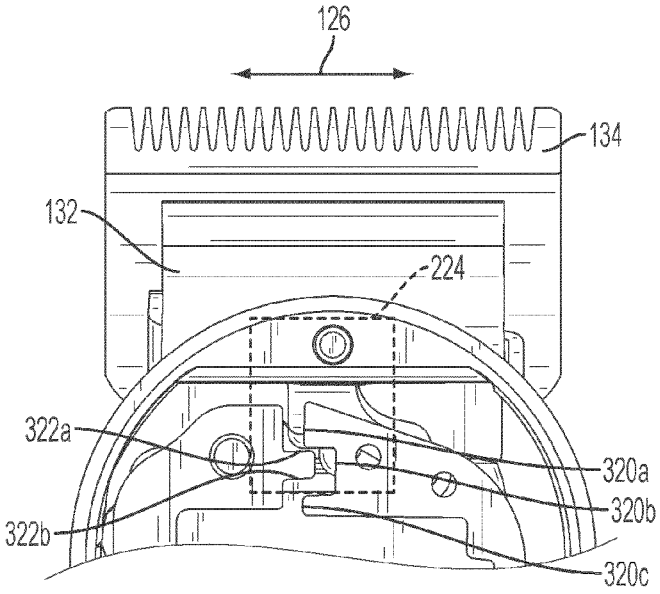
FIG. 13D is a cut-a-way view of the hair clipper of FIG. 1, showing the moving laminations in an open position, with the moving laminations skewed downwardly.

The pole faces 187, 188 and 189 of the stationary laminations 118 are shown in FIG. 12A, and the pole faces 165,167 and 169 of the moving laminations 122 are shown in FIG. 12B. The primary faces 187 and 165 are large compared with the secondary pole faces. Increasing the cross-sectional area of the primary pole faces 187 and 165 decreases reluctance of the air gaps which increases the magnetic flux flow in the magnetic flux zone 228, which increases the efficiency of the motor. Efficiency improvements may be achieved through thermal, magnetic, electrical, mechanical, and manufacturing improvements. A more efficient motor can produce higher power if desired, or lower temperature, lighter weight or smaller size, as desired. The primary leg behind the flange can be smaller which means that less wire is needed on the coil.

Figure 3B:
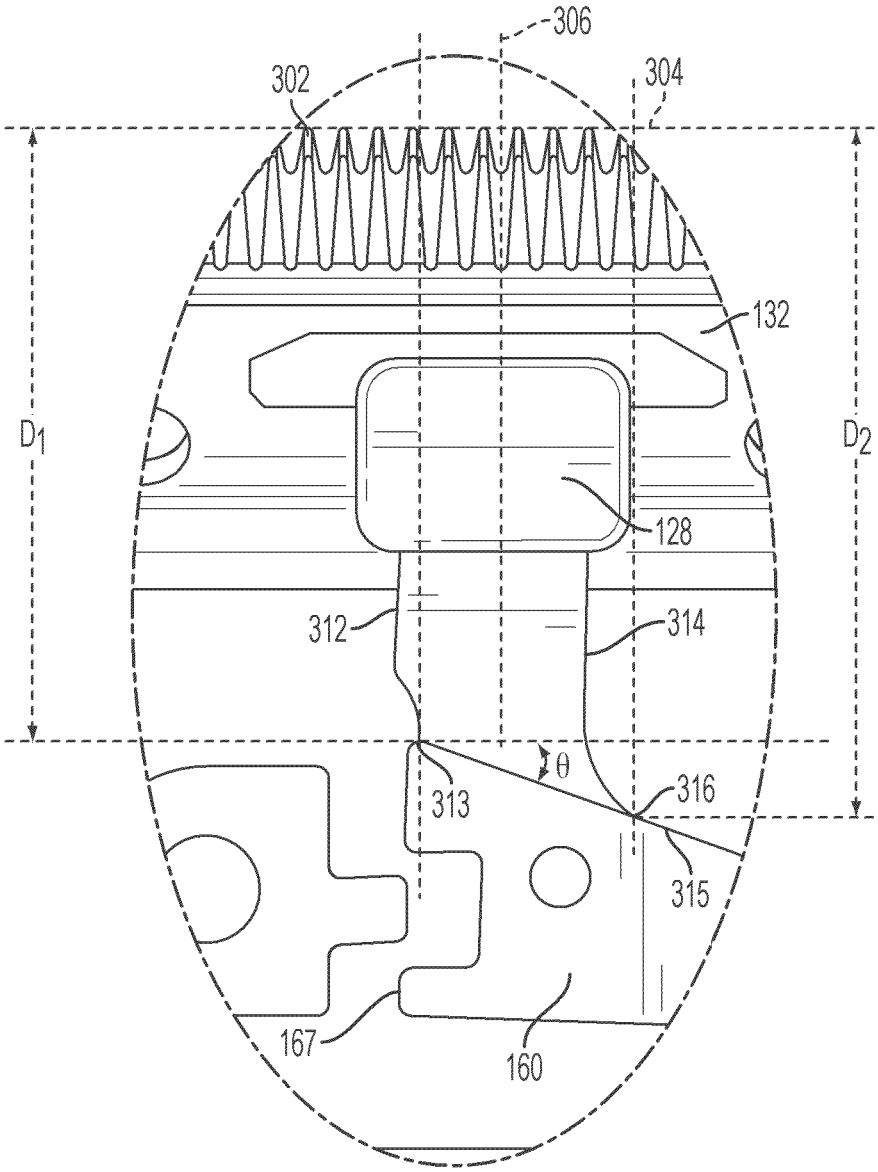
FIG. 3B is a magnified view of a portion of the vibrator motor of FIG. 3A.

Referring again to FIGS. 1, 3A and 3B, the stationary blade 134 has a straight row of teeth 300, and the reciprocating blade 132 has a row of complementary moving teeth 302 that form a cutting line 304. The moving blade 132 also has a center line 306 perpendicular to the cutting line 304. The reciprocating teeth 302 move back and forth in the directions indicated by the arrows 126 in a generally linear manner, and the cutting force is equally distributed among the teeth 302. In practice, though, unequal loads can be produced on the teeth 302. This problem has been addressed and solved by providing an angle θ between a line perpendicular to the center line 306 and an edge 315 of the moving laminations. An angle θ of about 17° can produce very even force across the teeth 302.

The drive arm 128 has a first side 312 located adjacent to the first secondary moving pole face 167 and intersecting the first arm 160 at a first intersection 313 of the side 312 and the edge 315.

The drive arm 128 has a second side 314 located away from the first secondary moving pole face 167 and intersecting the first arm 160 at a second intersection 316 of the side 314 and the edge 315. A first distance D1 between the cutting line 304 and the first intersection 313, measured parallel to the center line 306, is less than a second distance D2 between the cutting line 304 and the second intersection 316, also measured parallel to the center line 306.

The magnetic flux zone 224 has three major air gaps at faces 320*a*, 320*b*, 320*c*, and two minor air gaps at faces 322*a*, 322*b*, as seen in FIGS. 13*a*-13*d*. The force produced by the flux flow over the air gaps is affected by the size of the opposing faces, the size of the air gap, and the angle of magnetic force across the air gap. The pulling force of the motor is related to the effective size of the air gap. Ideally, there would be no manufacturing tolerances with respect to the position of the stationary laminations and the relative position of the moving laminations, which would produce constant, repetitive force across the air gap in the magnetic flux zone 224. In practice, however, there are tolerances, and the force can change. Changes in pulling force due to such tolerances is not reduced in the flux zone 224 because an increase in the air gap at 322*a* decreases the air gap in 322*b* and vise versa. The flux path will choose the smaller of these two gaps and use it. Older designs saw a 10% change in power consumption when alignment deteriorated. The present design shows only 1% change.

While the principles of the invention have been described above in connection with specific apparatus and applications, it is to be understood that this description is made only by way of example and not as a limitation on the scope of the invention.

What is claimed is:

1. A hair clipper comprising:

a housing, a stationary blade secured to the housing, the stationary blade having a row of cutting teeth, a moving blade having a row of complementary cutting teeth arranged so that hair that enters spaces between adjacent stationary cutting teeth is cut by reciprocating movement of the complementary teeth, and a vibrator motor secured to the housing, the vibrator motor comprising:

a mechanical spring system secured to the housing, a stationary magnetically permeable piece secured to the housing, the stationary piece having a spine and a transverse leg, the leg having a separate pole face, a complementary moving magnetically permeable piece secured to the mechanical spring system and having a general direction of movement towards and away from the stationary piece, the moving piece having a moving pole face, a drive arm secured to the moving piece and operably connected to the moving blade to cause the reciprocating movement, and a coil on the transverse leg of the stationary piece, wherein the separate pole face is secured to the leg by a press fit between a primary socket in the leg and a primary prong in the separate pole face, the leg and the separate pole face being further secured by a press fit between two secondary prongs in the leg and two secondary sockets in the separate pole face, the two secondary sockets guiding the two secondary prongs toward a center of the leg.

2. The hair clipper of claim 1, wherein the stationary piece has a second leg and a second pole face, and the moving piece has a second moving pole face.

3. The hair clipper of claim 2 wherein the second moving pole face is at an end of a first arm on the moving piece, the drive arm being secured to the first arm, the row of moving teeth on the moving blade defining a cutting line, the moving blade further having a center line perpendicular to the cutting line, the drive arm having a first side located adjacent to the secondary pole face and intersecting the first arm at a first intersection, the drive arm having a second side located away from the secondary pole face and intersecting the first arm at a second intersection, the first arm of the moving piece having an angled edge, so that a first distance between the cutting line and the first intersection, measured parallel to the center line, is less than a second distance between the cutting line and the second intersection, also measured parallel to the center line.

4. The hair clipper of claim 1, wherein the stationary piece has at least one notch along a far side of the spine of the stationary piece.

* * * * *